United States Patent [19]

Stern et al.

[11] 4,415,871

[45] Nov. 15, 1983

[54] DIELECTRIC WAVEGUIDE CIRCULATOR

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 310,542

[22] Filed: Oct. 13, 1981

[51] Int. Cl.[3] ..... H01P 1/383

[52] U.S. Cl. ..... 333/1.1; 333/248

[58] Field of Search ..... 333/1.1, 24.1–24.3

[56] References Cited

U.S. PATENT DOCUMENTS

| | | | |
|---|---|---|---|
| 3,327,247 | 6/1967 | Toda | 333/1.1 |
| 3,350,664 | 10/1967 | Pistilli et al. | 333/1.1 |
| 3,425,001 | 1/1969 | Hershenov | 333/1.1 |
| 3,636,479 | 1/1972 | Hartz et al. | 333/1.1 |
| 3,673,518 | 6/1972 | Carr | 333/1.1 |
| 4,034,377 | 7/1977 | Knox et al. | 333/1.1 X |

*Primary Examiner*—Paul L. Gensler

*Attorney, Agent, or Firm*—Robert P. Gibson; Jeremiah G. Murray; Edward Goldberg

[57] ABSTRACT

Millimeter wave circulators are disclosed for use with millimeter wavelength dielectric waveguides. The structure comprises a prism of magnetized ferrimagnetic material with the waveguide ends bonded to the lateral faces of the prism. The waveguide ends and the lateral faces are congruent rectangles. The prisms may have triangular bases in which case a Y-junction circulator results, or square bases with waveguide ends attached to three out of four of the lateral faces thereof, whereby a T-junction circulator results.

13 Claims, 10 Drawing Figures

DIELECTRIC WAVEGUIDE CIRCULATOR

The invention described herein may be maufactured, used, and licensed by or for the Government for Governmental purposes without the payment to us of any royalities thereon.

BACKGROUND OF THE INVENTION

This invention relates to millimeter wave circulators and more particularly to a novel and efficient circulator of this type which is useful in the millimeter (mm) wavelength region. Development of mm wavelength technology has been motivated by a desire to increase utilization of spectrum space and to permit miniaturization of components. Recently dielectric waveguides have been developed for military applications which operate at millimeter wavelengths, that is, between 40 and 220 GHz. At mm wavelengths dielectric waveguides are more efficient than conventional hollow metallic guides. A mm wave dielectric guide can have a width and height of 0.050 and 0.070 inches, respectively. The development of such guides involved a search for a material which would exhibit acceptable losses at these high frequencies. One such material is a ceramic composed of magnesium titanate. The effective utilization of these newly-developed waveguides depends on the development of numerous other control components capable of operating in the same frequency range. The present invention is one of these other components.

SUMMARY OF THE INVENTION

The structure of the invention comprises a plurality of mm wavelength dielectric guides all attached to different rectangular faces of a right prism, said prism comprising a dc magnetized microwave type ferrite selected to match as closely as possible the dielectric constant of the waveguide material.

A Y-junction circulator constructed according to the invention comprises a triangular prism in which the two bases are equilateral triangles and with the three dielectric guides bonded to the rectangular lateral faces thereof, such that the guides are spaced at 120° intervals around the prism axis.

Two permanent magnets provide the required dc magnetic field to produce the desired non-reciprocal action in the ferrite material.

In another embodiment of the invention, a T-junction circulator is provided by utilizing a right prism with square bases and dielectric guides terminating on three out of four mutually perpendicular rectangular lateral faces thereof.

DETAILED DESCRIPTION OF A PREFERRED EMBODIMENT

Figure 1:
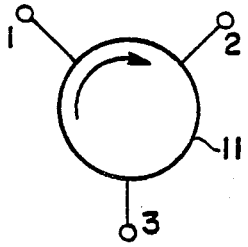
FIG. 1 is the symbol of a Y-junction circulator.

The symbol of a Y-junction circulator is shown in FIG. 1. Such a circulator is a non-reciprocal device in which energy is transmitted from one of its three ports to an adjacent port while decoupling the signal from the third port. The symbol of FIG. 1 with the indicated counterclockwise circulation means that substantially all the energy applied to port 1 will emerge from port 2, that applied to port 2 emerges from port 3, and energy applied to port 3 emerges from port 1. The non-reciprocal action is obtained by means of a dc magnetized ferrimagnetic material such as a ferrite, indicated by numeral 11 in FIG. 1. The dc field and rf magnetic field from the applied signal are arranged at right angles to each other and the interaction of these field produces a composite field pattern such that the desired coupling and isolation between the ports is obtained. Reversal of the direction of the dc magnetic field will reverse the direction of circulation, for example from clockwise to counterclockwise.

Prior art types of circulators have been constructed for use with conventional hollow metallic waveguides. Such circulators may comprise three H-plane hollow guides arranged to converge on a central dc biased ferrite or garnet post. Stripline circulators are used at VHF and low microwave frequencies and usually include coaxial connectors connected to the three strip-lines which are spaced by 120°. The intersection of the strip-lines contains a pair of ferrimagnetic discs, one on each side of the stripline.

These prior art circulators have used air dielectric waveguides and the large difference in dielectric constant between the air and the ferrimagnetic material has caused impedance mismatches which have restricted the bandwidth and generally degraded performance. Attempts have been made to minimize this problem by for example using tuned stubs between the arms of the stripline circulator and varying the stripline width where it passes over the ferrite material. Also, dielectric rings have been employed for impedance matching purposes. U.S. Pat. Nos. 3,636,479, Hartz et al, and 3,673,518, Carr, describe efforts directed to this problem. The present inventors, by closely matching the characteristics of the ferrimagnetic material to that of the waveguide material, have obviated this mismatch problem.

Figure 2:
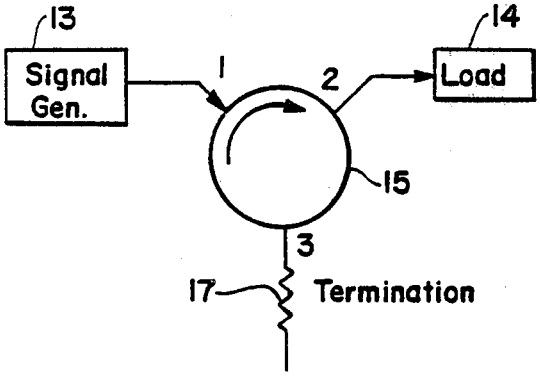
FIGS. 2–4 show different applications in which circulators are useful.

Such circulators have found many useful applications in the prior art. One of these applications is shown in FIG. 2 wherein signal generator 13 has its output applied to port 1 of a Y-junction circulator. The generator output will emerge from port 2, which may for example be an antenna or other load. If the load or antenna connected to port 2 happens to be mismatched even slightly, undesired reflections would normally be returned to the signal generator. These reflections can have deleterious effects on the operation of some signal generators, for example they can affect the frequency or stability thereof. In order to prevent these reflections from reaching the signal generator, a resistive termination 17 is connected to port 3, as shown. Thus any reflections from the load 14 will re-enter the circulator at port 2 and emerge from port 3 to be harmlessly absorbed in termination 17.

Figure 3:
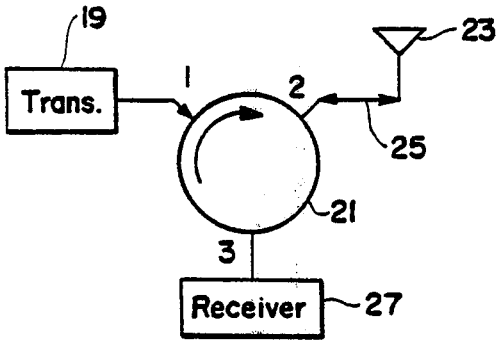

FIG. 3 shows how a Y-junction circulator can be connected to a CW radar transmitter 19, a radar antenna 23, and a radar receiver 27 to permit the single antenna 23 to transmit and receive without any undesired coupling between the transmitter and receiver. As indicated by the double-headed arrow 25, the antenna carries both the outgoing transmitted signal and the incoming radar echoes. Due to the circulator action, none of the transmitter output reaches the receiver and the echo signals are all applied to the receiver.

Figure 4:
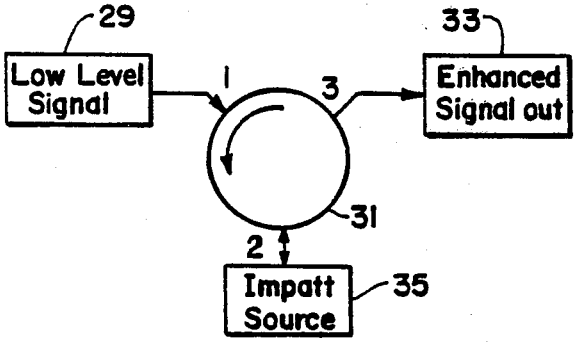

In FIG. 4 a low level signal to be amplified by Impatt source 35 is applied to port 1. This signal emerges from port 2 and is amplified by Impatt source 35 which is a negative resistance device. The amplified signal enters port 2 and is circulated to output port 3.

Figure 5:
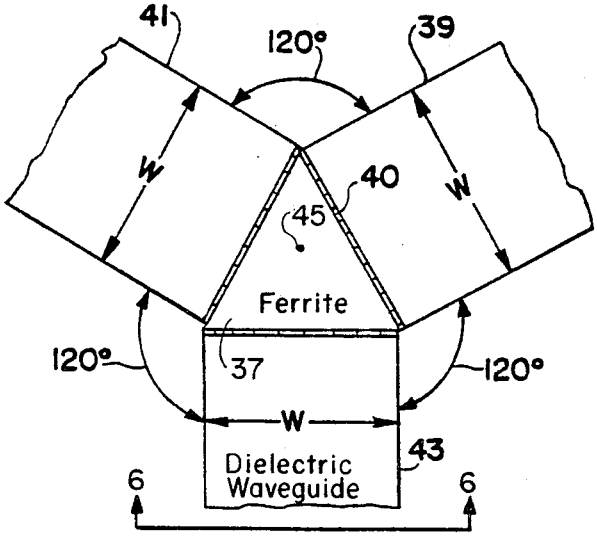
FIGS. 5 and 6 show respectively, top and side views of a Y-junction circulator constructed according to the principles of the present invention.
Figure 6:
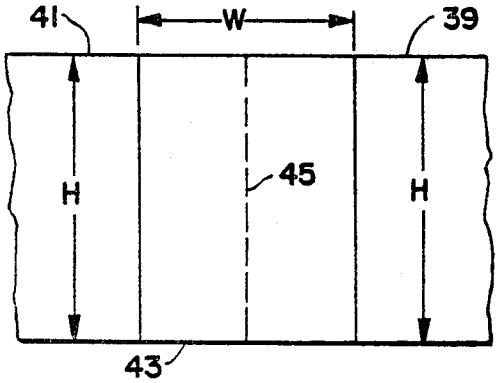

The novel millimeter wavelength Y-junction circulator of FIGS. 5 and 6 comprises three dielectric wavelengths 39, 41, and 43 arranged symmetrically around a central right prism 37. The prism is composed entirely of ferrimagnetic material and is suitably magnetically biased to produce the desired circulator action. The prism 37 has bases, one of which is shown in FIG. 5, which are equilateral triangles, and the length of its axis 45 (or the perpendicular distance between its two bases) is longer than the sides of the triangular bases. Thus the lateral faces of prism 37 are rectangles with the long sides thereof at right angles to the planes of the triangular bases. The three dielectric waveguides have cross-sections with the same dimensions as the lateral faces of the prism and thus the waveguides, when attached to the prism as shown in FIGS. 5 and 6, will fully cover all three lateral faces of the prism. The waveguides have a height of H and width W, as indicated on the drawings, and thus the triangular prism's axis is equal to H in length. The dashed line 45 of FIG. 6 and the dot 45 of FIG. 5 indicate the prism axis, which is the axis of the cylinder which circumscribes the prism. The waveguide ends are bonded to the prism faces by means of a low loss ashesive 40, which can be for example, an epoxy compound.

The dielectric waveguides, the independent development of which made the present invention necessary, are composed of a low loss ceramic material comprising magnesium titanate. This material has a dielectric constant ($\epsilon$) of approximately 16. In order to minimize impedance discontinuities and mismatches at the circulator, the dielectric constant of the ferrimagnetic material of the prism must be as close as possible to that of the waveguides. The closest match is obtained with a prism of lithium ferrite which has a dielectric constant of 15½–16. The inventors have found that nickel-zinc ferrite having a dielectric constant of 13 can also perform satisfactorily in this application.

Figure 7:
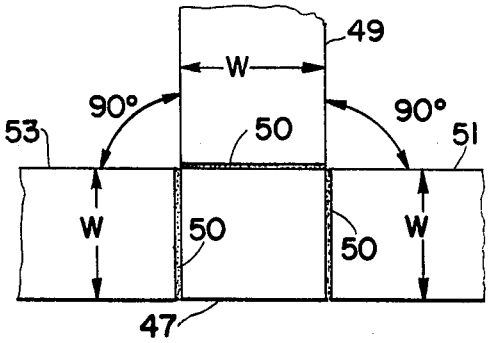
FIGS. 7 and 8 are top and side views of a novel T-junction circulator of the present invention.
Figure 8:
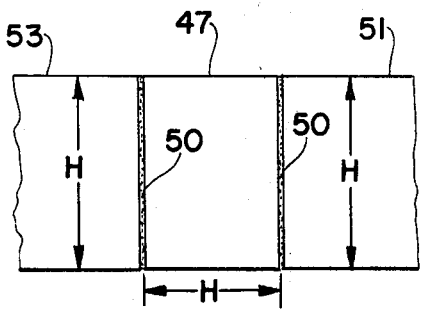

In the T-junction circulator of FIGS. 7 and 8, the ferrimagnetic material is in the form of a right prism 47 having square bases and an axial length H, which is longer than the sides of the square, W. This again results in four rectangular lateral faces, having the sides of the square bases as their short sides. As shown, three out of four of the lateral faces have dielectric waveguides 49, 51, and 53 attached thereto, bonded by means of adhesive material 50 which is similar to that used in the Y-junction circulator described above. The waveguides all have height and width equal to H and W and thus their cross sections are congruent with the lateral faces of the prism.

While the T-junction circulator would be advantageous for certain applications because of its shape, it lacks symmetry around its center and thus the characteristics of all three ports are not the same. This can be a disadvantage in some applications.

Figure 9:
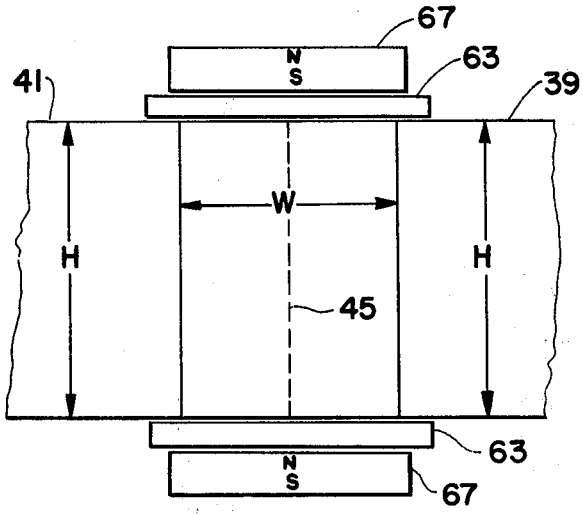
FIG. 9 shows how the dc magnetic fleid may be applied to the circulators of the present invention.

FIG. 9 shows how the magnetic bias can be applied to the previously described circulators. The Y-junction circulator of this FIGURE is the same as that of FIGS. 5 and 6. Disc shaped dielectric spacers 63 are bonded to the triangular bases of the prism, and cylindrical permanent magnets 67 are in turn bonded to the dielectric spacers. The magnets have the indicated polarity so that their magnetic fields add to provide the required degree of magnetization within the ferrimagnetic prism. The magnets are shown as cylinders, but other shapes are possible, for example they could be triangular to match the shape of the prism bases.

Figure 10:
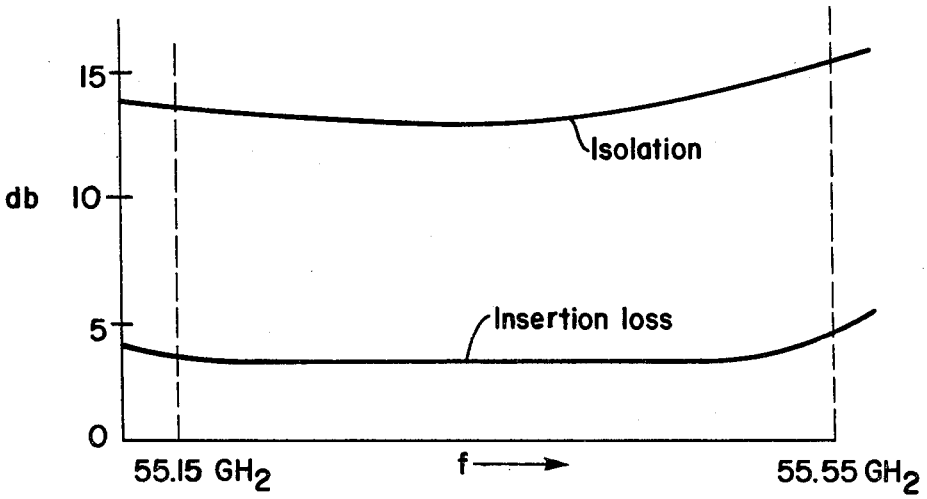
FIG. 10 is a graph showing the performance of a circulator constructed according to the teachings of this invention.

The graph of FIG. 10 shows the performance of a Y-junction circulator constructed according to the invention, similar to that of FIGS. 5 and 6. The waveguide material was magnesium titanate made by Trans-Tech Co. and sold under the name "D-13 Dielectric". The triangular prism was the aforementioned lithium ferrite made by the same company and known as "TT-4100 LI". The waveguide and prism dimensions H and W, were 0.070 and 0.050 inches, respectively. The data of FIG. 10 shows that this device had a bandwidth of 350 MHz, between 55.15 and 55.55 GHz, and that in this band the insertion loss was no more than 2.8 db with isolation between decoupled ports of 11.0 db or greater.

This invention thus provides compact and lightweight circulators of non-complex and inexpensive design.

While the invention has been described in connection with preferred embodiments, obvious variations therein will occur to those skilled in the art without departing from the teachings of the invention. Accordingly, the invention should be limited only by the scope of the appended claims.

We claim:

1. A millimeter wavelength circulator comprising a polygonal prism of a non-reciprocal ferrimagnetic material having a plurality of equal lateral rectangular faces and two equal opposite bases, a plurality of millimeter wavelength dielectric waveguides having equal ends congruent with said lateral faces, one end of each of said waveguides being attached to a respective different lateral face of said prism, and means applying a dc magnetic field between said opposite bases.

2. The circulator of claim 1 wherein said prism has equilateral triangular bases and the axial length of said prism is greater than the length of the sides of said triangular bases, whereby said circulator is a Y-junction circulator.

3. The circulator of claim 1 wherein said prism has square bases with an axial length greater than the sides of said square bases and said plurality of waveguides is three.

4. The circulator of claim 1 wherein said waveguides are composed of a low loss ceramic magnesium titanate material and said prism is of a lithium ferrite material, said materials having dielectric constants which are close in value to provide close impedance matching therebetween.

5. The circulator of claim 1 wherein respective said waveguide ends are bonded to said lateral faces by means of a low loss adhesive material.

6. The circulator of claim 1 wherein said means applying a dc magnetic field includes a pair of permanent magnets disposed at said opposite bases and having additive magnetic fields for magnetizing said ferrimagnetic prism.

7. The circulator of claim 6 including dielectric spacers secured to said opposite bases, said magnets being secured to and overlying said spacers.

8. A Y-junction circulator comprising a dc magnetized triangular right prism having non-reciprocal properties and rectangular lateral faces, three millimeter wavelength dielectric waveguides having rectangular ends bonded to the respective lateral faces of said prism, the waveguide ends being congruent with the lateral faces of said prism.

9. The circulator of claim 8 wherein said prism has an axial length, H, which is greater than the length of the sides, W, of the triangular bases of said prism, and wherein said dielectric waveguide has a length equal to W and a height equal to H.

10. The circulator of claim 8 wherein the dielectric constant of said prism is approximately the same as that of said dielectric waveguide.

11. A T-junction circulator comprising a dc magnetized right prism with square bases and four rectangular lateral faces and having non-reciprocal properties, three dielectric millimeter wavelength waveguides having respective rectangular ends attached to three of the four lateral faces of said prism, the waveguide ends being congruent with the lateral faces of said prism.

12. The circulator of claim 11 wherein the axial length, H, of said prism is greater than the length of the sides, W, of said square bases and wherein said waveguides have width, W, and height H.

13. The circulator of claim 11 wherein the dielectric constant of said prism is approximately the same as that of said dielectric waveguide.

* * * * *